US006513997B2

(12) United States Patent
Terao

(10) Patent No.: US 6,513,997 B2
(45) Date of Patent: Feb. 4, 2003

(54) WIRE DOT PRINTER HEAD AND WIRE DOT PRINTER USING THE SAME

(75) Inventor: Yasunobu Terao, Tagata-gun (JP)

(73) Assignee: Toshiba TEC Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/905,867

(22) Filed: Jul. 17, 2001

(65) Prior Publication Data

US 2002/0012557 A1 Jan. 31, 2002

(30) Foreign Application Priority Data

Jul. 17, 2000 (JP) ..... 2000-215692

(51) Int. Cl.[7] ..... B41J 2/22; B41J 2/30
(52) U.S. Cl. ..... 400/124.01; 400/124.04
(58) Field of Search ..... 400/124.01–124.05

(56) References Cited

U.S. PATENT DOCUMENTS

| | | | | |
|---|---|---|---|---|
| 4,437,775 A | | 3/1984 | Ochiai et al. | 400/124.01 |
| 4,441,828 A | | 4/1984 | Ochiai et al. | 400/124.01 |
| 4,447,166 A | | 5/1984 | Ochiai et al. | 400/124.01 |
| 4,602,301 A | | 7/1986 | Saito et al. | 360/69 |
| 4,624,589 A | * | 11/1986 | Ochiai et al. | 400/124.01 |
| 4,652,950 A | | 3/1987 | Ichitani et al. | 360/105 |
| 4,802,781 A | * | 2/1989 | Sheerer | 400/124.01 |
| 4,951,158 A | | 8/1990 | Ichitani | 358/451 |
| 5,009,528 A | | 4/1991 | Horii et al. | 400/124.01 |
| 5,096,313 A | | 3/1992 | Horii | 400/124.01 |
| 5,123,759 A | | 6/1992 | Horii et al. | 400/124.01 |
| 5,163,761 A | | 11/1992 | Horii et al. | 400/124.01 |

FOREIGN PATENT DOCUMENTS

| | | |
|---|---|---|
| JP | 54-24115 | 2/1979 |
| JP | 2958010 | 7/1999 |

* cited by examiner

*Primary Examiner*—Raquel Yvette Gordon
*Assistant Examiner*—An H. Do
(74) *Attorney, Agent, or Firm*—Oblon, Spivak, McClelland, Maier & Neustadt, P.C.

(57) ABSTRACT

A structure for supporting wires driven by armatures displaced under electrical excitation for coils and applying an impact force for a printing operation of a sheet. Extremity ends of the wires are supported independently and slidably by guide holes arranged at extremity end guides which are set such that wires having rear ends adjacent to each other within a certain range are applied as one sub-group, the extremity ends of the wires being arranged on a straight line in the sub-scanning direction, and the arrangement positions of the extremity ends of the wires in the main scanning direction are different in response to a difference in the arrangement positions of the rear ends of the wires for every sub-group different in that the bending stress of the corresponding is low as compared with that where the extremity ends of all the wires are arranged on the straight line.

10 Claims, 13 Drawing Sheets

WIRE DOT PRINTER HEAD AND WIRE DOT PRINTER USING THE SAME

CROSS REFERENCE TO RELATED APPLICATION

The present application is based on Japanese Priority Document 2000-215692 filed on Jul. 17, 2000, the content of which is incorporated herein by reference.

BACKGROUND OF THE INVENTION

1. Field of the Invention

The present invention relates to a wire dot printer and a wire dot printer using the same.

2. Discussion of the Background

There is already provided in the related art a wire dot printer head in which a plurality of cores and yokes arranged in an annular shape are integrally formed by magnetic material, a coil is fitted to each of these cores, a plurality of armatures having wires fixed at their extremity ends with means such as a brazing and the like are arranged in a radial form, and supported so as to be raised or lowered in respect to the cores, and the extremity ends of the wires are arranged in rows by the extremity end guides to be slidably supported. Such a wire dot printer head as above is moved in a main scanning direction in parallel with the platen while being mounted on a carrier, the specified coil is excited during its moving process to drive the armature and then the extremity ends of the wires are struck against the printing medium on the platen to perform a printing operation.

In turn, when the extremity ends of the wires are arranged in rows by the extremity end guide on a straight line extending along a sub-scanning direction crossing at a right angle with a main scanning direction acting as a moving direction of the wire dot printer head, for example, if an alpha-numerical letter of "I" is printed, the wires arranged in the sub-scanning direction must be driven at once. With such an arrangement as above, some problems, for instance, that the capacity of power supply is increased and noise generated when the wires strike against the platen is increased, occur.

In view of this fact, as already described in the gazette of Japanese Patent Laid-Open No.Sho 54-24115, there is provided a proposal in which the extremity ends of the wires are arranged in two rows along the sub-scanning direction, the extremity ends of the wires are arranged in a zig-zag form in such a way that the arrangement positions in the sub-scanning direction of the wires in the first row and the wires in the second row are displaced only by a pitch corresponding to a half of a diameter of wire, and even in the case where the letter of "I" is to be printed, all the wires in the first row are driven, thereafter the wire dot printer head is moved in the main scanning direction only by a space between the wire in the first row and the wire in the second row, and then all the wires in the second row are driven, whereby one character is printed in twice operations.

In addition, as already described in the gazette of Japanese Patent No.2958010, the extremity ends of the wires are arranged on the two arcs or arranged along a contour of rhomb.

However, when the extremity ends of the wires are arranged on the arc or the contour of rhomb, it may provide an effect that the number of wires driven at once can be reduced. However, the number of drivers driving the wires under a different timing is increased and control over the application of voltage becomes complicated.

In view of this fact, it is yet desired to provide a configuration in which the extremity ends of the wires are arranged on a straight line along the sub-scanning direction. Also in the case where the extremity ends of the wires are arranged on the straight line, the configuration in which the wires are classified in two rows and arranged in a zig-zag form can perform a printing by driving the entire wires in separate two segments and then the capacitance of the power supply and noise can be reduced to a certain degree. This configuration is sometimes employed in a specific less-expensive product because the number of drivers can be sufficiently less and a control is not so complicated as compared with the configuration in which the extremity ends of the wires are arranged on an arc and on a contour of rhomb.

As described above, in the case of the wire dot printer head having the structure in which the extremity ends of the wires are arranged on the straight line along the sub-scanning direction, the armatures are oppositely faced against the cores arranged in an annular form, thereby the rear ends of the wires are arranged in an annular form and the extremity ends are arranged on the straight line, so that the wires are bent little by little by a plurality of guides as the wires are faced from the rear ends toward the extremity ends. As the plurality of guides, it is needed to provide an intermediate guide for forcedly bending the intermediate part of the wires and the extremity end guides which arranges the extremity ends of the wire on the straight line. In addition, it is also carried out that either one vibration-proof guide or a plurality of vibration-proof guides for preventing wires to contact each other when an impact is applied are arranged between the intermediate guide and the armatures.

Referring to FIGS. 9 to 13, this example will be described as follows. FIG. 9 is an illustration for showing the arrangement pattern of the extremity ends of the wires. This arrangement is attained by the extremity end guide and the number of wires is 24 (called as 24-pin), although the extremity ends of the wires 9 are classified into two rows in parallel with the sub-scanning direction (the direction of arrow Y) and arranged on the straight line in the same manner as that described in the gazette of Japanese Patent Laid-Open No.Sho 54-24115. In FIG. 9, as the wires 9 in the left row, the wires 9 in odd number from upper 1 (#1) to 23 (#23) are arranged and as the wires in the right row, the wires 9 in even number from upper 2 (#2) to 24 (#24). The arrangement positions of the wires 9 arranged in two rows in the sub-scanning direction are displaced only by a ½ of an arrangement pitch (p) in the sub-scanning direction of the wires 9 in every row. A row space of the wires 9 divided in two rows is 1/20 inch at a center distance.

FIG. 10 is an illustration for showing the coordinate positions at a plurality of locations in the same plane ranging from the rear ends to the extremity ends of the wires in respect to the center of the wire dot printer head. The plurality of locations correspond to the rear ends of the wires (portions brazed to the armatures) indicated by □ mark; the portions supported by the first vibration-proof guides indicated by + mark; the portions supported by the second vibration-proof guides indicated by ◇ mark; the portions supported by the intermediate guide indicated by x mark; and the portions supported by the extremity end guides indicated by the ○ mark, respectively.

FIG. 11 is an illustration for showing a distance ranging from the rear ends (□) to the extremity ends (○) of the wires on the same plane including the extremity end surfaces of the wires. As shown in FIG. 11, it is apparent that a distance L indicated by a straight line ranging from the rear ends (□)

to the extremity ends (○) of the wires is short as the wires are directed to the upper part and the lower part of the row, and long as the wires are arranged near the center of the row. The length of this distance L is proportional to a wire bending amount and a bending stress.

In the case where the first and second vibration-proof guides are members for restricting the wires to contact each other when impact is applied, the wires do not accept any pressure from the first and second vibration-proof guides under their standstill state. However, the they are bent by the intermediate guide and the extremity end guide, and the wires arranged near the center of the row and having large amount of bending receives higher load from the extremity end guide and the intermediate guide. FIG. 12 is a graph in which a relation between the wire arrangement positions and a load accepted by the wires from the extremity end guide and the intermediate guide is attained by experiment. Numerical values indicated at an abscissa denote wire arrangement positions (No. 1 to No. 24) and numerical values indicated at an ordinate denote a sum of a lad that the wires accept from the extremity end guide and the intermediate guide.

FIG. 13 is a graph in which a relation between the wire arrangement positions and a wire bending is attained by experiment. Numerical values indicated at an abscissa denote wire arrangement positions (No. 1 to No. 24) and numerical values indicated at an ordinate denote a wire bending stress. In this graph, ① indicates a wire bending stress under a non-printing state:

② indicates a wire bending stress when the wires strike against the platen: and

③ indicates a sum of stresses ① and ②.

As apparent from the foregoing description, if the wire extremity ends are arranged on the straight line along the sub-scanning direction, the wires arranged near the center of the row, when the wire is seen from the extremity ends, may accept a large bending amount, a large bending stress and a large load accepted from the extremity end guide and the intermediate guide and their sliding characteristic is deteriorated. As a result, there occurs a problem that the brazed part at the rear end is peeled off at the armatures due to repetition of printing operation.

SUMMARY OF THE INVENTION

Accordingly, an object of the present invention is to reduce a wire bending stress and improve durability without making any complex control over the printing operation.

The object of the present invention is achieved by the novel dot printer head and dot printer using the same of the present invention.

According to the novel dot printer head of the present invention, a plurality of wires driven by the armatures displaced under electrical excitation to the coils to apply an impact force for printing operation are supported by the extremity end guide. The extremity end guide has a plurality of guide holes for independently and slidably supporting the extremity ends of the wires and arranging them in rows. The guide holes at the extremity end guide form one or more groups, and the extremity end guide holes in each of the groups are set such that the wires are classified into a plurality of sub-groups with a plurality of wires where the rear ends of wires are adjacent to each other within a specified range being classified as one sub-group, the extremity ends of the wires are arranged on a straight line in a sub-scanning direction in a unit of each of the sub-groups, and the arrangement positions of the extremity ends of the wires in the main scanning direction are made different in response to a difference in the arrangement positions of the rear ends of the wires for every different sub-groups such that the bending stress of the corresponding wires may become low as compared with the case where the extremity ends of all the wires are arranged on a straight line.

Another aspect of the present invention relates to a wire dot printer using the wire dot printer head of the present invention. According to the novel dot printer of the present invention, a sheet transferring passage for guiding a sheet, transfer rollers for transferring the sheet in the sheet transferring passage, a platen arranged along the sheet transferring passage and a wire dot printer head of the present invention are provided, wherein voltage is applied to the coil for driving respective wires in response to the arrangement positions of the wire extremity ends in the main scanning direction while changing its timing.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENT

Figure 1:
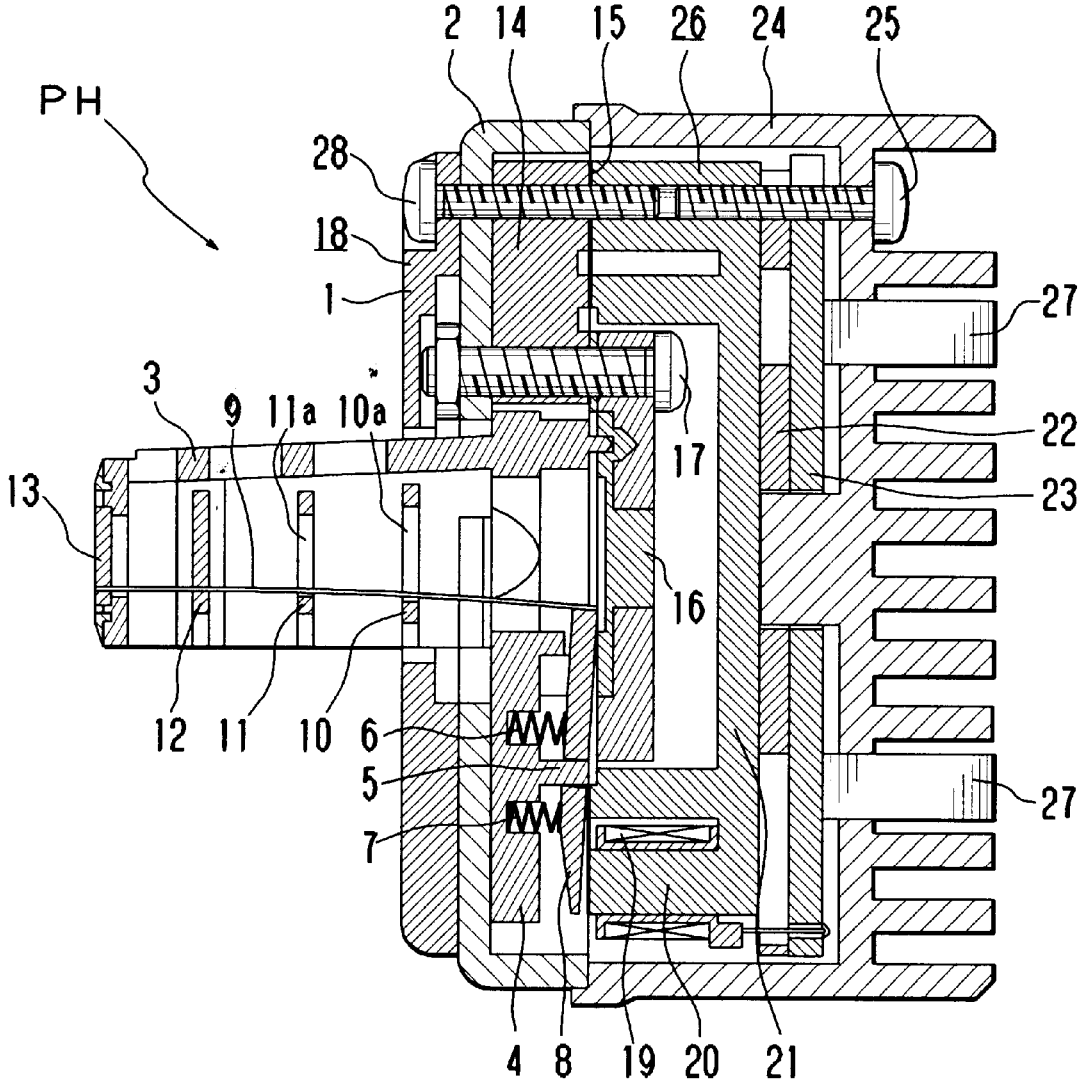
FIG. 1 is a side elevational in longitudinal section for showing a configuration of a wire dot printer head in one preferred embodiment of the present invention.

Referring to FIG. 1, a schematic configuration of a wire dot printer head PH of one preferred embodiment of the present invention is described.

In this figure, reference numeral 1 denotes a fixing member fixed to a carrier (to be described below) of a wire dot printer, and 2 denotes a container-like front cover whose one end opens. An armature guide 4 abutted against the bottom surface of the front cover 2 is integrally formed with one end of a wire guide 3 projected out of the bottom part of the front cover 2. This armature guide 4 is formed with a plurality of guide pins 5 and protuberance pieces (not shown) for use in guiding both sides of the armature 8. An armature spring 6 and a fulcrum pressing spring 7 are arranged inside and outside the guide pin 5 and held. In addition, a plurality of wires 9 fixed to the free end of the armature 8 by brazing, for example, are slidably held by a first vibration-proof guide 10, a second vibration-proof guide 11, an intermediate guide 12 and an extremity end guide 13, which are fixed to the wire guide 3. Further, a plurality of stopper receptacles 14 are fitted to the armature guide 4. Then, the armature 8 is inserted into the guide pin 5 while the wire 9 is being inserted through the guides 10 to 13, and the bottom surface of the front cover 2, the stopper receptacle 14, a film 15 formed by non-magnetic material and the armature stopper 16 are stacked and connected by a screw 17 to form an armature block 18.

Then, a plurality of cores 20 and yokes 21 having each of coils 19 installed therein are integrally formed. Then, the yoke 21, a ring-like spacer 22, a base plate 23 to which the coils 19 are electrically connected and a container-like housing 24 are stacked and coupled by a plurality of screws 25 to form a yoke block 26. To the base plate 23 are connected connectors 27 connected to an external circuit.

Then, a plurality of screws 28 passing through the fixing member 1, the front cover 2, the film 15, and the stopper receptacle 14 are threadably engaged with the yoke 21 to couple the armature block 18 and the yoke block 26 so as to accomplish the wire dot printer head PH.

Although the wire dot printer having such a wire dot printer head PH mounted thereon will be described later, the operation of the wire dot printer head PH will now be described. The coils 19 are magnetically excited during a process in which the wire dot printer head PH is reciprocatively driven together with the carrier in the main scanning direction in parallel with the platen, thereby the armature 8 is retracted to the end surface of the core 20, whereby although not shown, the wire 9 strikes against the sheet on the platen through an ink ribbon to perform a printing operation. When an electrical excitation to the coils 19 is interrupted, the armature 8 returns by a biasing force of the armature spring 6 to define the returning position by the armature stopper 16.

Figure 2:
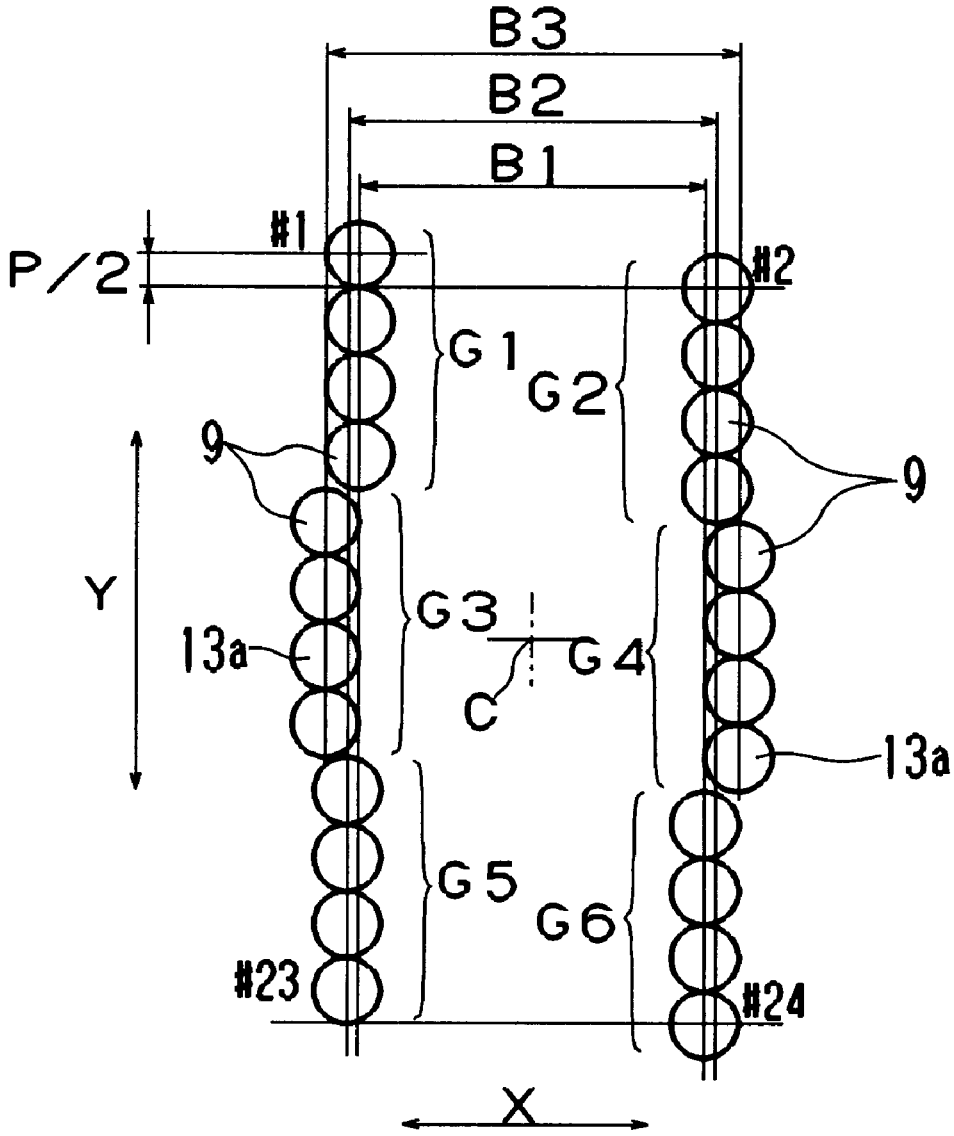
FIG. 2 is an illustration for showing an arrangement pattern of the extremity ends of the wires.

Then, a feature of the wire dot printer head PH of the present invention will be described. FIG. 2 is an illustration for showing an arrangement pattern of the extremity ends of the wires 9. Circles indicating the extremity ends of the wires 9 are also the arrangement patterns of the guide holes 13*a* formed at the extremity end guide 13. In the preferred embodiment, the number of wires 9 is 24 (called as 24-pin) and the extremity ends of the wires 9 are roughly arranged in two lateral rows (2 groups) so as to extend in parallel with the sub-scanning direction (the direction of arrow Y). In this preferred embodiment, the rough divided two groups substantially form rows, so that the "group" will be described as a "row". The laterally divided and arranged guide holes 13*a* are displaced little by little in their main scanning direction (the direction X) for every row, although its reason will be described later. In FIG. 2, the wires 9 in the left side row are arranged such that the wires 9 of odd numbers are arranged in the order of No. 1 (#1) to No. 23 (#23) from above and in turn the wires 9 in the right side row are arranged such that the wires 9 of even numbers are arranged in the order of No. 2 (#2) to No. 24 (#24) from above.

Figure 3:
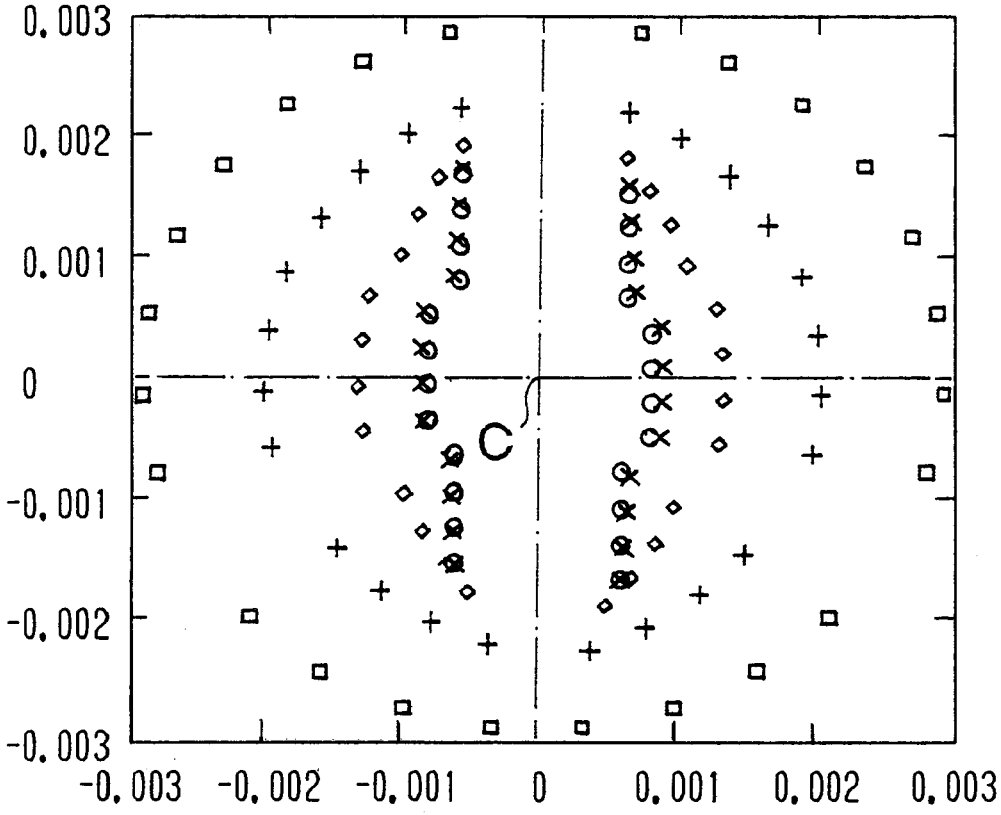
FIG. 3 is an illustration in which the coordinate positions at a plurality of locations of the wires ranging from the rear ends to the extremity ends of the wires in respect to the center of the wire dot printer head are indicated on the same plane.

FIG. 3 is an illustration for showing the coordinate positions at a plurality of locations ranging from the rear ends to the extremity ends of the wires 9 in respect to the center C of the wire dot printer head PH in the same plane. The plurality of locations correspond to the rear ends of the wires 9 (portions brazed to the armatures 8) indicated by □ mark; the portions supported by the first vibration-proof guides 10 indicated by + mark; the portions supported by the second vibration-proof guides 11 indicated by ◇ mark; the portions supported by the intermediate guide 12 indicated by x mark; and the portions supported by the extremity end guides 13 indicated by the ○ mark, respectively.

Figure 4:
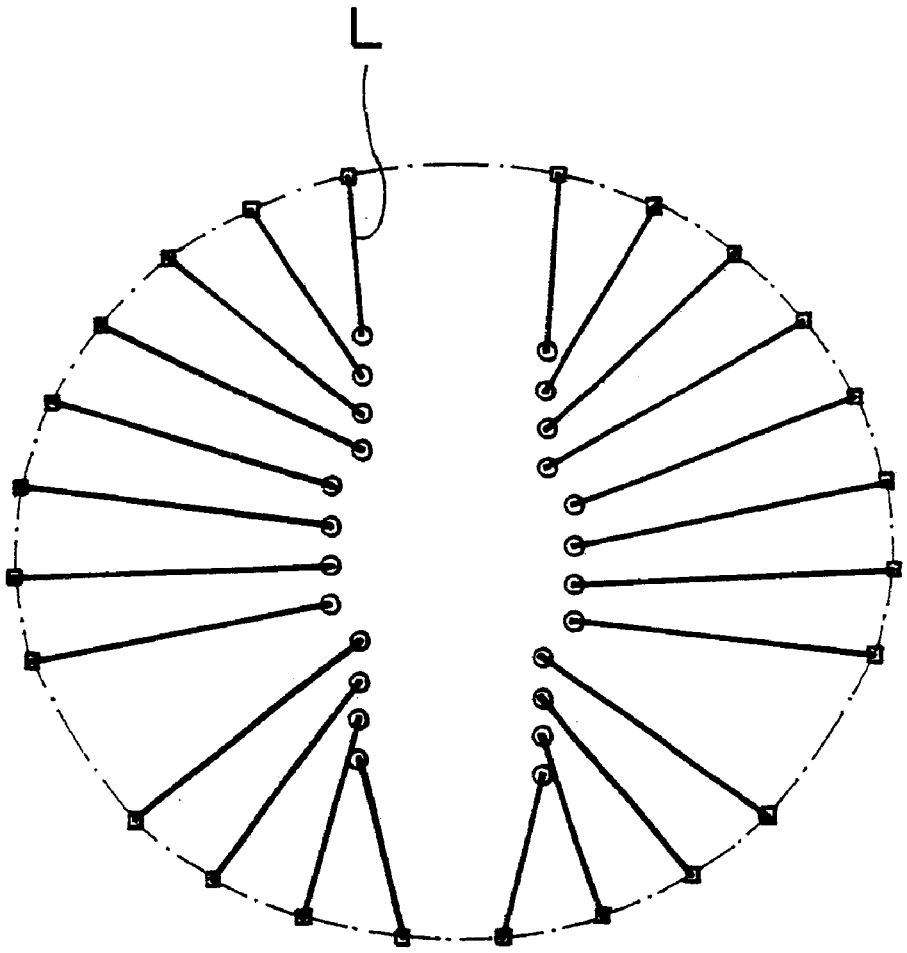
FIG. 4 is an illustration for showing the distance ranging from the rear ends to the extremity ends of the wires on the same plane including the extremity end surfaces of the wires.

FIG. 4 is an illustration for showing a distance ranging from the rear ends (□) to the extremity ends (○) of the wires 9 on the same plane including the extremity end surfaces of the wires 9. In FIG. 4, it is apparent that a distance L indicated by a straight line ranging from the rear ends (□) to the extremity ends (○) of each of the wires 9 is short as the wires are directed to the upper part and the lower part of the row, and long as the wires are arranged near the center of the row. The length of this distance L is proportional to a wire bending amount and a bending stress of each of the wires 9.

Then, as shown in FIG. 2, the extremity end guide 13 is configured such that a plurality of wires 9 (four wires in this example) having the rear ends thereof adjacent to each other within a specified range are defined as one sub-group, the wires 9 are classified into a plurality of sub-groups G1 to G6, the extremity ends of the wires 9 are arranged on the straight line in a unit of classified sub-groups in a sub-scanning direction, the different sub-groups G1 to G6 satisfy a condition making a different arrangement position of the extremity ends of each of the wires 9 in the main scanning direction such that a bending stress of the wire 9 may not exceed a specified value in view of a difference in the arrangement positions of the rear ends of the wires 9 (in other words, in such a way that the distance L shown in FIG. 4 may not exceed the specified value).

Whether or not the rear ends (□) of each of the wires 9 are kept at their adjoining relation within a specified range can be acknowledged by superposing the positions of the extremity ends of the wires 9 from No. 1 to No. 24 indicated in FIG. 2 on the positions shown in FIG. 4 and checking a straight line indicating a distance L in reference to a relation between the extremity ends (○) and the rear ends (□) of each of the wires 9.

Describing this condition by another expression shows that as illustrated in FIG. 2, the extremity end guide 13 is set such that a plurality of guide holes 13*a* independently supporting the extremity ends of the wires 9 are divided in two rows along the sub-scanning direction in parallel to it, the arrangement positions of the guide holes 13*a* arranged in two rows in the main scanning direction are defined such that the bending stress of the wire 9 may not exceed a specified value in reference to a difference of the arrangement positions of the rear ends of the wires 9 (in other words, the distance L indicated in FIG. 4 may not exceed a specified value), and the guide holes 13*a* arranged near the center of the row rather than the arrangement positions of the guide holes 13*a* arranged near the ends of the divided rows may expand the inter-row space in the symmetrical direction.

The aforesaid arrangement patterns will be described more practically in reference to FIG. 2. The extremity ends (the guide holes 13*a*) of the wires 9 in the left side row and the right side row are classified as sub-groups G1, G2 near the upper end of the row; sub-groups G3, G4 near the center of the row; and sub-groups G5, G6 near the lower end of the row, respectively. Each of the extremity ends (the guide holes 13*a*) of the wires 9 in each of the sub-groups G1 to G6 is in a relation such that the position of the rear end (□) of each of the wires 9 is adjacent to each other within a specified range.

Then, if it is assumed that an inter-row space of the extremity ends (the guide holes 13*a*) of the wires 9 in the sub-groups G1, G6 is defined as B1, an inter-row space of the extremity ends (the guide holes 13*a*) of the wires 9 in the sub-groups G5, G2 is defined as B2, and an inter-row space of the extremity ends (the guide holes 13*a*) of the wires 9 in the sub-groups G3, G4 near the center is defined as B3, these values are set to have a relation of B1<B2<B3. This is due to the fact that the arrangement positions of the guide holes 13*a* of inter-rows are set in a point-symmetrical state in respect to the center C (the center C of the wire dot printer head PH) of the arrangement region of the guide holes 13*a*. In addition, the position of the straight line passing through the center of the guide hole 13*a* for every sub-groups G1, G3, G5 in the left row in the main scanning direction is made different from each other. Similarly, the position of the straight line passing through the center of the guide hole 13*a* for every sub-groups G2, G4, G6 in the right row in the main scanning direction is made different from each other. This is due to the fact that the wires 9 in the plural sub-groups are not driven simultaneously whatever resolution degree of printing is carried out. Further, the arrangement positions of the extremity ends (the guide holes 13*a*) of the wires 9 arranged in divided two rows in the sub-scanning direction are displaced only by ½ of an arrangement pitch (p) of the wires 9 (the guide holes 13*a*) for every row in the sub-scanning direction.

In the preferred embodiment, the first and second vibration-proof guides 10, 11 are members for restricting the wires 9 to contact each other at the time of applying impact and they are formed with large openings 10*a*, 11*a* for passing the wires 9 with a sufficient room shown in FIG. 1. If the openings can pass the wires 9 with the sufficient room, the openings 10*a*, 11*a* can be replaced with a plurality of independent holes. Accordingly, the wires 9 do not accept any pressure from the first and second vibration-proof guides 10, 11 at the time of standstill.

The intermediate guide 12 is formed with guide holes (not shown) for use in guiding the wires 9 arranged with their rear ends being widened into the extremity end guide 13 while bending them. Accordingly, the wires 9 are bent by the intermediate guide 12 and the extremity end guide 13.

Figure 5:
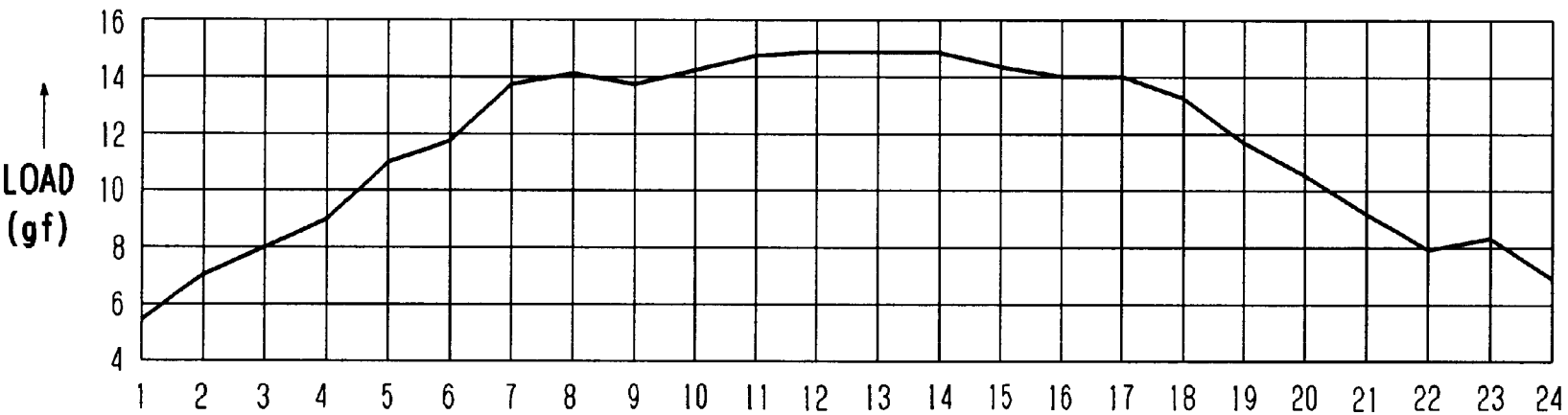
FIG. 5 is a graph in which a relation between the wire arrangement positions and a load of the wire received from the extremity end guide and the intermediate guide is attained by experiment.

As already described above in reference to FIG. 4, it is apparent that a distance L indicated by a straight line ranging from the rear ends (□) to the extremity ends (○) of each of the wires 9 is short as the wires are directed to the upper part and the lower part of the row, and long as the wires 9 are arranged near the center of the row. The length of this distance L is proportional to a bending amount and a bending stress of each of the wires 9, so that a lad that the wires 9 may receive from the extremity end guide 13 and the intermediate guide 12 is increased as the wires 9 having a large bending amount in the sub-groups G3, G4 arranged near the center of the row are applied as shown in FIG. 5. FIG. 5 is a graph in which a relation between the arrangement positions of the wires 9 and a lad that the wires 9 may accept from the extremity end guide 13 and the intermediate guide 12 is obtained by an experiment. The numerical values at an abscissa denote arrangement positions (No. 1 to No. 24) of the wires and the numerical values at an ordinate denote a sum of lad that the wires may accept from the extremity end guide 13 and lad that the wires may accept from the intermediate guide 12.

Figure 12:
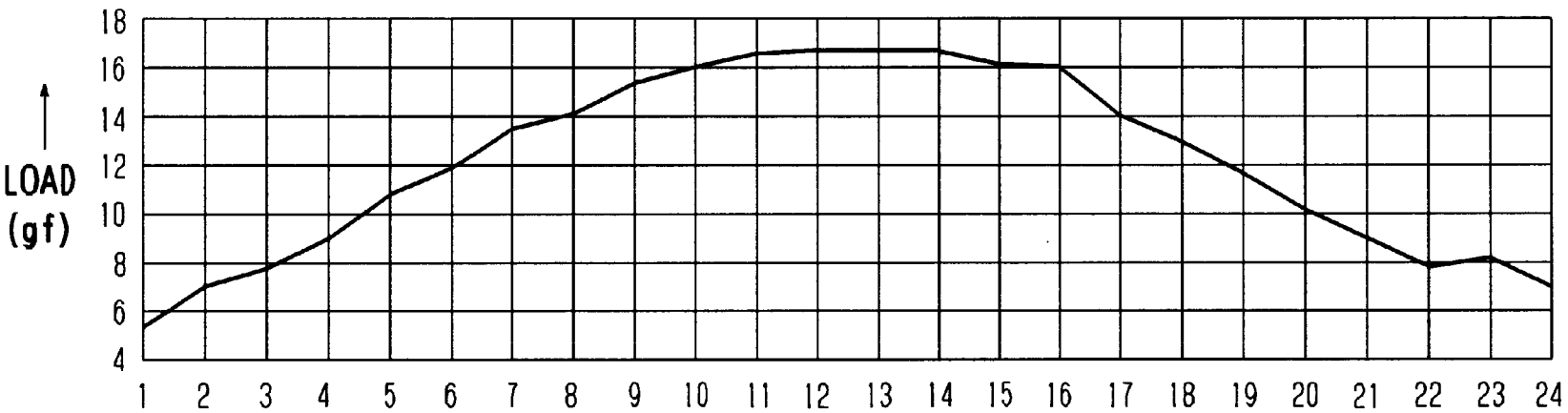
FIG. 12 is a graph in which a relation between the wire arrangement positions and a load of the wire received from the extremity end guide and the intermediate guide is attained by experiment.

As shown in FIG. 5, it is apparent that the lad that the wires 9 may accept from the extremity end guide 13 and the intermediate guide 12 is about 15 gf which is less than a specified value (16 gf) at the most and this value is reduced by about 2 gf than that of the prior art as shown in FIG. 12. This is due to the fact that the arrangement positions of the extremity ends (the guide holes 13*a*) of the wires 9 in the sub-groups G3, G4 having poor condition arranged near the center of the extremity end guide 13 are set such that the inter-row spaces are expanded more in a symmetrical direction than that of the arrangement positions of the extremity ends (the guide holes 13*a*) of the wires 9 in the sub-groups G1, G2, G5 and G6 having a better condition and the bending stress of the wire 9 is reduced by shortening the length of the distance L shown in FIG. 4.

Figure 6:
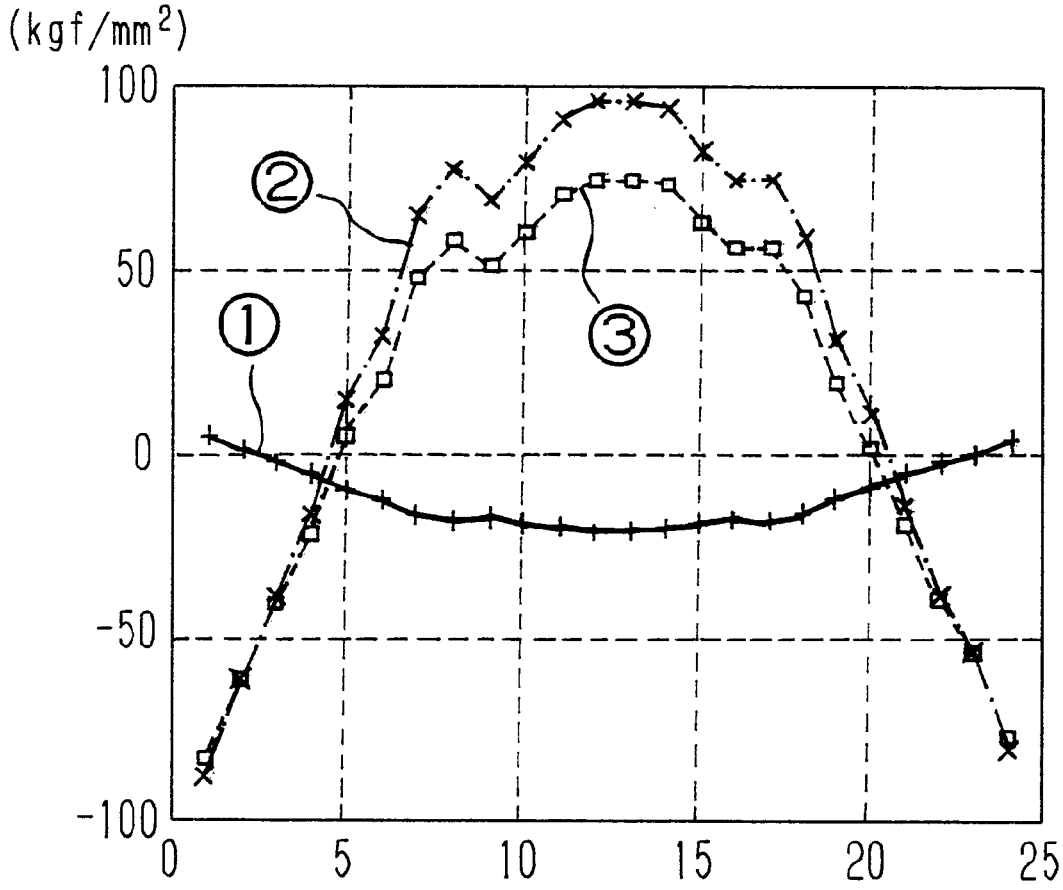
FIG. 6 is a graph in which a relation between the wire arrangement positions and a wire bending is attained by experiment.

As described above, the fact that the bending stress could be reduced could be confirmed by experiment. FIG. 6 is a graph for showing the fact that a relation between the arrangement positions of the wires 9 and the bending stress of the wires 9 is attained by experiment. The numerical values indicated at the abscissa denote arrangement positions (No. 1 to No. 24) of the wires and the numeral values indicated at an ordinate denote a bending stress of the wires. In this graph, ① indicates a wire bending stress under a non-printing state:

② indicates a wire bending stress when the wires strike against the platen: and

③ indicates a sum of stresses ① and ②.

Figure 13:
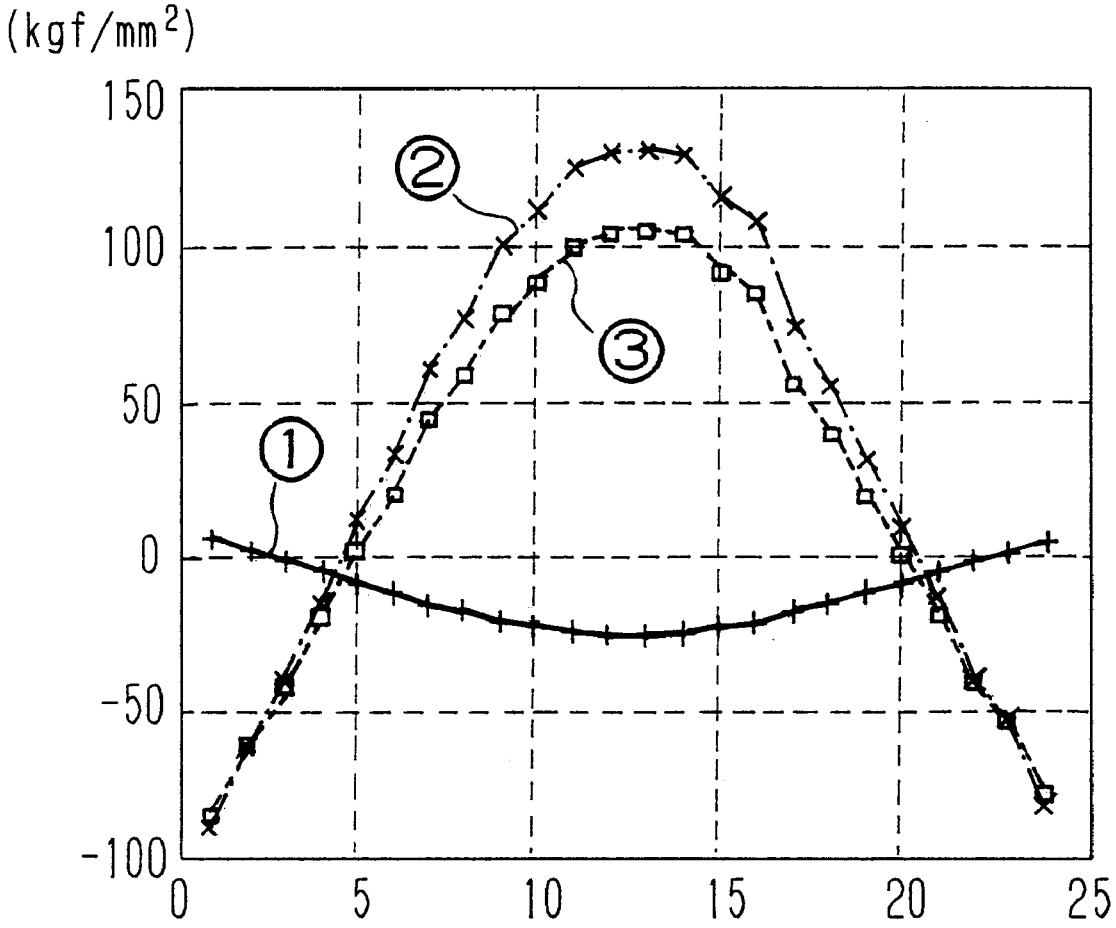
FIG. 13 is a graph in which a relation between the wire arrangement positions and a wire bending is attained by experiment.

As apparent from the result of experiment shown in FIG. 6, even in the case of wires 9 in the sub-groups G3, G4 having poor condition, the highest bending stress at the time of striking could be reduced to about 100 kgf/mm$^2$ which is smaller than a value (about 130 kgf /mm$^2$) attained by the conventional result of experiment (refer to FIG. 13).

Further, as shown in FIG. 2, the arrangement positions of the guide holes 13*a* arranged in two rows in the sub-scanning direction are displaced only by ½ of an arrangement pitch of the guide holes 13*a* in every row in the sub-scanning direction and the arrangement positions of the inter-row guide holes 13*a* form a point-symmetrical state in respect to the center C of the arrangement region of the guide holes 13*a*, so that when the dots by the wires 9 having their extremity ends arranged in two rows are overlapped to each other, a dot density in the sub-scanning direction can be increased.

Figure 7:
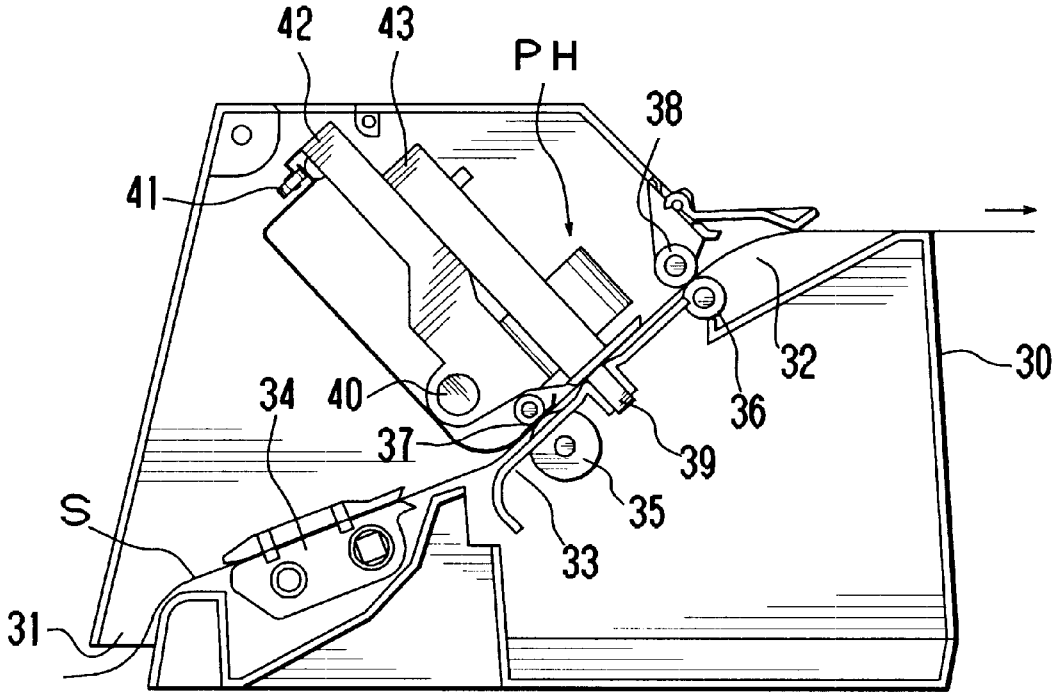
FIG. 7 is a side elevational view in longitudinal section for showing a schematic configuration of a wire dot printer having the wire dot printer head of the present invention mounted thereon.
Figure 8:
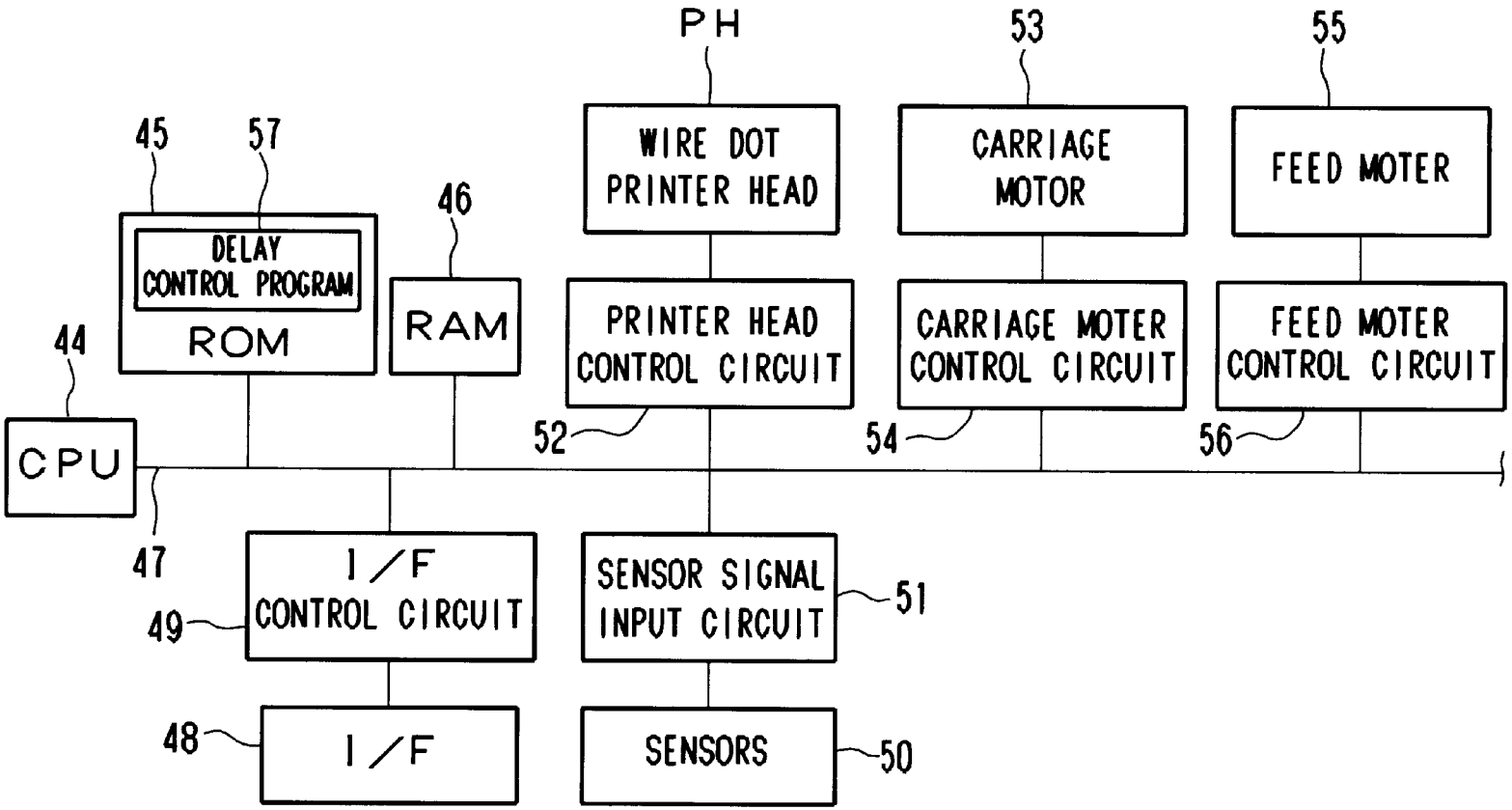
FIG. 8 is a block diagram for showing an electrical connecting structure of a wire dot printer.
Figure 9:
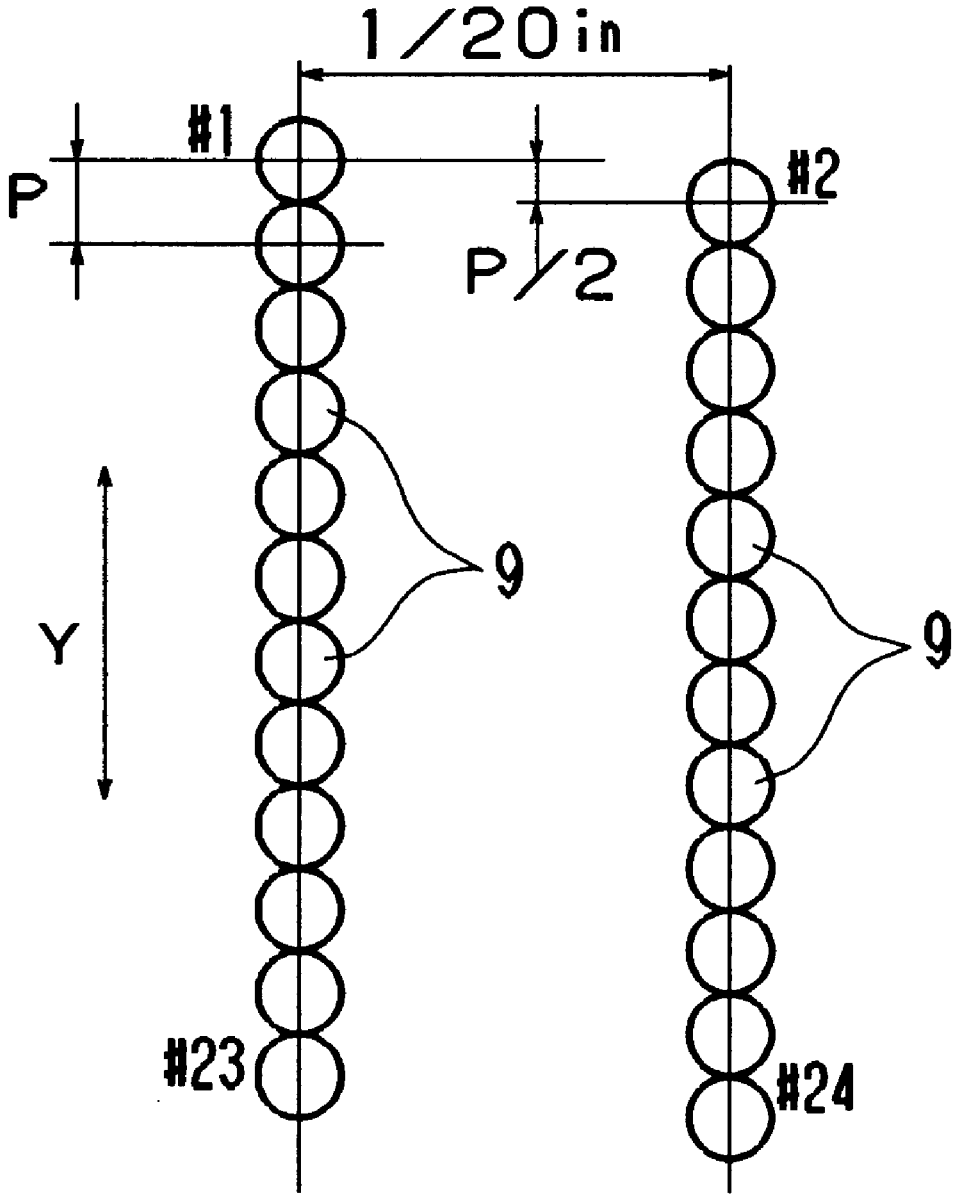
FIG. 9 is an illustration for showing one example of a conventional arrangement pattern of the wire extremity ends.
Figure 10:
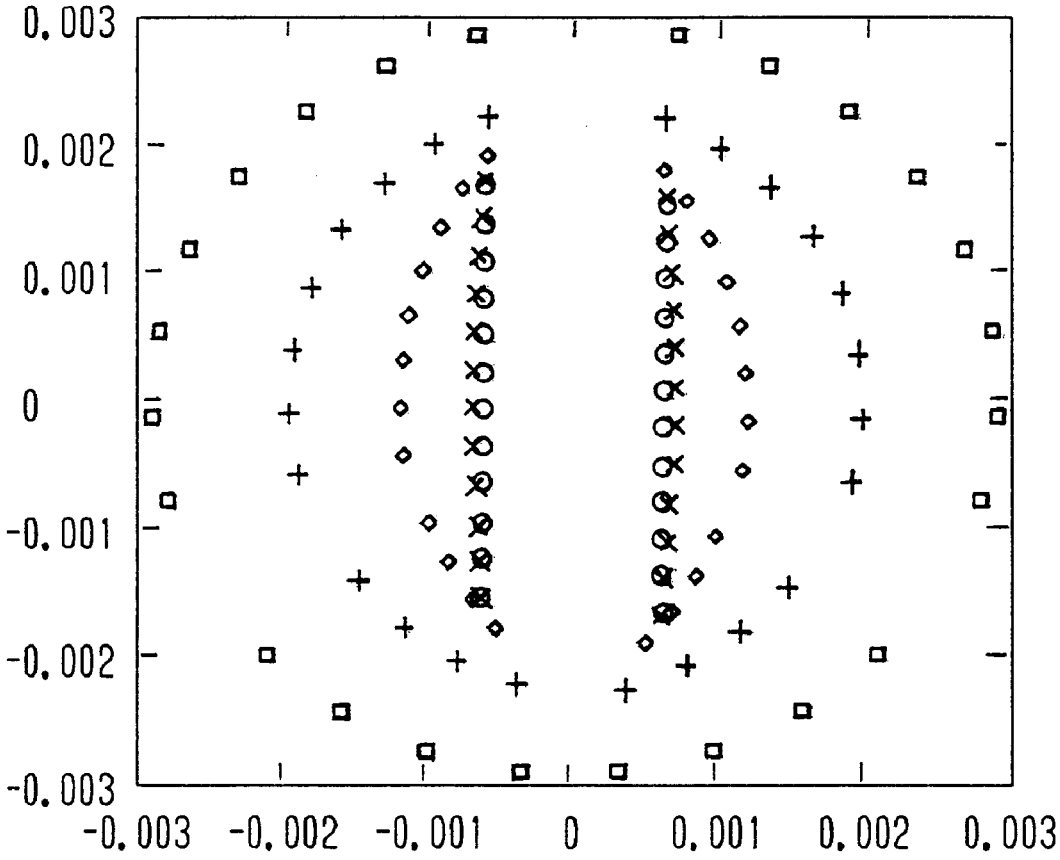
FIG. 10 is an illustration in which the coordinate positions at a plurality of locations of the wires ranging from the rear ends to the extremity ends of the wires in respect to the center of the wire dot printer head are indicated on the same plane.
Figure 11:
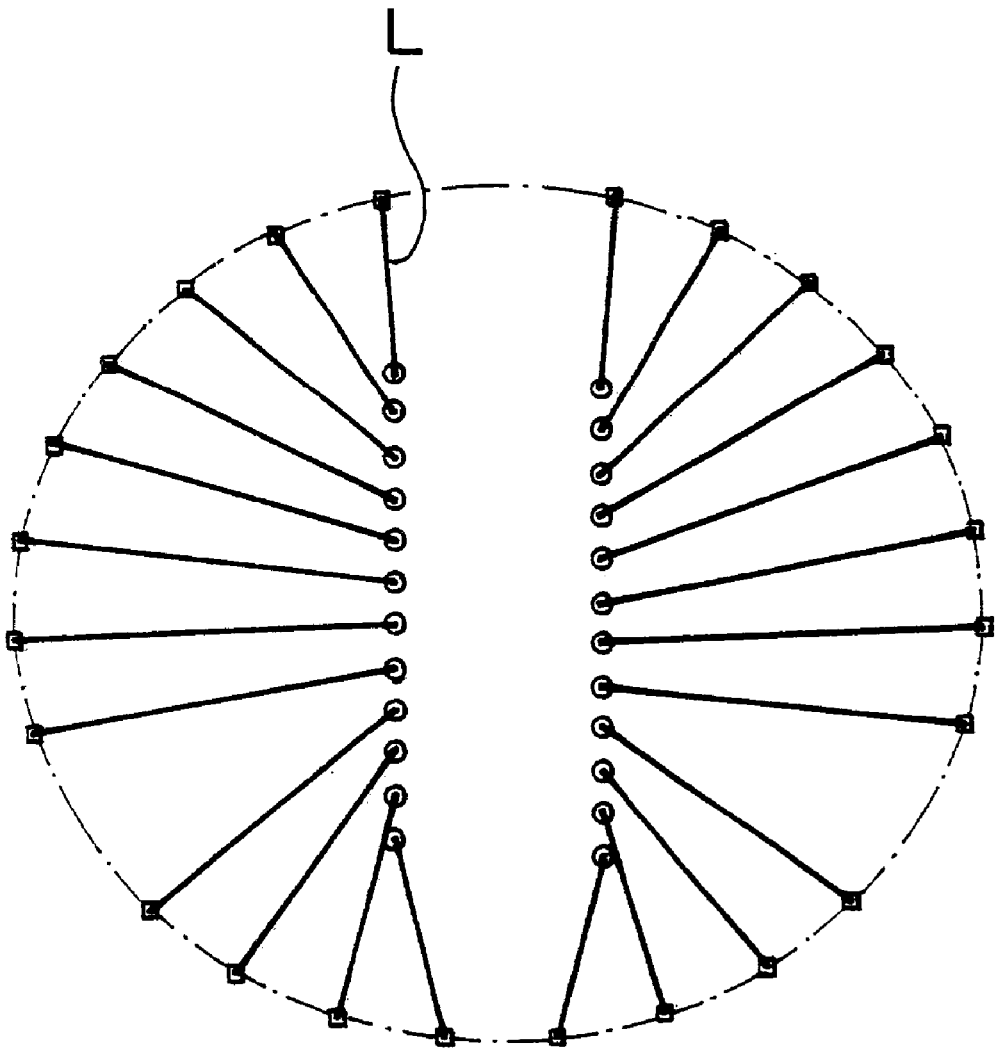
FIG. 11 is an illustration for showing a distance ranging from the rear end to the extremity end of the wire on the same plane including the extremity end surface of the wire.

Then, referring to FIGS. 7 and 8, the configuration of the wire dot printer provided with the wire dot printer head PH described above will be described. FIG. 7 is a side elevational view in longitudinal section for showing a schematic structure of the wire dot printer and FIG. 8 is a side elevational view in longitudinal section for showing an electrical connecting structure.

In FIG. 7, reference numeral 30 denotes a casing. This casing 30 is formed with a sheet transferring passage 33 extending from a sheet feeder port 31 to a sheet discharging port 32, and the sheet transferring passage 33 is provided with a tractor 34 and transfer rollers 35, 36 acting as the sheet transferring means for transferring each of the sheets S, and the pinch rollers 35, 36 are press contacted with these transfer rollers 35, 36. In addition, a platen 39 is arranged between the transfer rollers 35, 36. In addition, a carrier 42 is movably supported in a main scanning direction along a longitudinal direction of the platen 39 by the carrier shaft 40 and the carrier guide 41. The wire dot printer head PH shown in FIG. 1 is fixed to the carrier 42 through the fixing member 1. In addition, a ribbon cassette 43 for supplying an ink ribbon between the platen 39 and the extremity end of the wire dot printer head PH is removably attached to the carrier 42.

Then, referring to FIG. 8, an electrical connecting structure will be described as follows. CPU 44, ROM 45 and RAM 46 are connected by a system bus 47. Then, to the CPU 44 are connected, via the system bus 47, an interface control circuit 49 for controlling an interface 48 communicating with an external device (not shown) by signal; a sensor control circuit 51 to which various kinds of sensors 50 including a sheet sensor for outputting a signal in response to a transferring state of the sheet S in the sheet transferring passage 33 and a carrier sensor for sensing the position of the carrier 42 are connected; a head control circuit 52 for controlling an operation of the wire dot printer head PH; a carrier motor control circuit 54 for controlling an operation of the carrier motor 53; and a transfer motor control circuit 56 for controlling an operation of the transferring motor 55 and the like.

In addition, the carrier motor can be rotated normally or in a reverse direction and this is provided with a carrier driving mechanism (not shown) for use in converting its rotating motion into a linear motion and transmitting it to the carrier 42. In addition, the transferring motor 55 is connected to a rotating shaft of each of the tractor 34, the rollers 35, 36 so as to drive them.

With such an arrangement as above, the sheet S is supplied by the tractor 34 and further transferred by the transfer rollers 35, 36 and the pinch rollers 37, 38. When the printing position of the sheet S reaches the wire dot printer head PH, transferring of the sheet S is stopped, the carrier motor 53 is driven, the carrier 42 is moved together with the wire dot printer head PH in the main scanning direction, and during this stage, the coil is electrically excited by the head control circuit 52 in response to the image data, thereby the desired image is printed on the sheet S.

In addition, as described above, the wire dot printer head PH mounted on the wire dot printer is set such that as shown in FIG. 2, the extremity ends of the wires 9 are arranged roughly in such a way that the arrangement positions in the main scanning direction are classified in two rows and its detailed state shows that the arrangement positions in the main scanning direction are classified into six sub-groups G1 to G6 and arranged.

Accordingly, in the case where all the wires 9 are driven and the letter of alpha-numerical "I", for example, is to be printed, during a process in which the wire dot printer head PH is moved in the main scanning direction, at first, voltage is applied to the coils 19 for driving the wires 9 in the sub-group G3 and similarly, application of this voltage is performed in delay in the order of the sub-groups G5, G1, G6, G2 and G4. Since the arrangement positions of the extremity ends of the wires 9 are already defined as design values, this control is operated such that a delay control program 57 for setting in sequence a timing for applying voltage to the coils 19 is stored in ROM 45, and CPU 44 controls the operation of the head control circuit 52 in response to the delay control program while the transferring position of the carrier 42 is being monitored. The series of controls may realize the voltage applying control means for performing an application of the voltage for the coils 19 by changing the timing in response to the arrangement positions in the main scanning direction at the extremity ends of the wires 9.

Obviously, numerous modifications and variations of the present invention are possible in light of the above teachings. It is therefore to be understood that within the scope of the appended claims, the invention may be practiced otherwise than as specifically described herein.

What is claimed is:

1. A wire dot printer head, comprising:

a yoke;

a plurality of cores arranged in an annular form on the yoke;

a plurality of coils combined with the cores so as to fit the cores;

a plurality of armatures supported so as to be raised or lowered in respect to the cores;

a plurality of wires supported at the free ends of the armatures in such a way that they may be driven and displaced; and an extremity end guide having a plurality of guide holes for independently and slidably supporting the extremity ends of the wires to arrange them;

wherein the guide holes of the extremity end guide form one or more groups, the extremity end guide holes in each of the groups are set such that a plurality of wires having rear ends adjacent to each other within a certain range serves as one sub-group, the wires are classified into a plurality of sub-groups, the extremity ends of the wires are arranged on a straight line in the sub-scanning direction, and the arrangement positions of the extremity ends of the wires in the main scanning direction are made different in response to a difference in the arrangement positions of the rear ends of the wires for every sub-groups different in such a way that the bending stress of the corresponding wire may become low as compared with that where the extremity ends of all the wires are arranged on the straight line.

2. A wire dot printer head according to claim 1, wherein the groups of guide holes are classified into a pair of groups opposing through the sub-scanning line, each of the groups is made such that the sub-group in a unit of the guide holes arranged near the center and the guide holes arranged near the end part is attained, and an inter-group space of the sub-group of the guide holes arranged near the center is wider than that of the sub-group of the guide holes arranged near the end.

3. A wire dot printer head according to claim 2, wherein the row positions of the corresponding guide holes in the two groups in the sub-scanning direction are displaced only by ½ of an arrangement pitch of the guide holes in the sub-scanning direction for every group and the arrangement positions of the guide holes between the groups are set to have a point symmetrical state in respect to the center of the arrangement region of the guide holes.

4. A wire dot printer head according to claim 1, wherein the rear ends of the wires are fixed to the free ends of the armatures.

5. A wire dot printer head according to claim 4, wherein a fixing between the rear ends of the wires and the free ends of the armatures is performed by a brazing.

6. A wire dot printer, comprising:

a sheet transferring passage for guiding a sheet;

transferring rollers for transferring the sheet in the sheet transferring passage;

a platen arranged along the sheet transferring passage;

a wire dot printer head; comprising a yoke;

a plurality of cores arranged in an annular form on the yoke;

a plurality of coils combined with the cores so as to fit the cores;

a plurality of armatures supported so as to be raised or lowered in respect to the cores;

a plurality of wires supported at the free ends of the armatures in such a way that they may be driven and displaced; and an extremity end guide having a plurality of guide holes for independently and slidably supporting the extremity ends of the wires and arranging them, wherein, the guide holes of the extremity end guide form one or more groups, the extremity end guide holes in each of the groups are set such that a plurality of wires having rear ends adjacent to each other within a certain range are applied as one sub-group, the wires are classified into a plurality of sub-groups, the extremity ends of the wires are arranged in a unit of sub group on a straight line in the sub-scanning direction, and the arrangement positions of the extremity ends of the wires in the main scanning direction are made different in response to a difference in the arrangement positions of the rear ends of the wires for every sub-groups different in such a way that the bending stress of the corresponding wire may become low as compared with that where the extremity ends of all the wires are arranged on the straight line.

wherein the wire dot printer head is faced against the platen through the sheet transferring passage and movably held in the width direction of the sheet transferring passage; and means for performing a voltage application to the coils driving respective wires in response to the arrangement positions of the extremity ends of the wires in the main scanning direction while changing timing therefor.

7. A wire dot printer according to claim 6, wherein the groups of guide holes are classified into a pair of groups opposing through the sub-scanning line, each of the groups is made such that the sub-group in a unit of the guide holes arranged near the center and the guide holes arranged near the end part is attained, and an inter-group space of the sub-group of the guide holes arranged near the center is wider than that of the sub-group of the guide holes arranged near the end.

8. A wire dot printer according to claim 7, wherein the row positions of the corresponding guide holes in the two groups in the sub-scanning direction are displaced only by ½ of an arrangement pitch of the guide holes in the sub-scanning direction for every group and the arrangement positions of the guide holes between the groups are set to have a point symmetrical state in respect to the center of the arrangement region of the guide holes.

9. A wire dot printer head according to claim 6, wherein the rear ends of the wires are fixed to the free ends of the armatures.

10. A wire dot printer head according to claim 9, wherein a fixing between the rear ends of the wires and the free ends of the armatures is performed by brazing.

* * * * *